United States Patent [19]

Scott

[11] Patent Number: 4,937,019

[45] Date of Patent: Jun. 26, 1990

[54] PRESSURE VESSEL

[75] Inventor: Alistair Scott, Cambridge, United Kingdom

[73] Assignee: Isoworth Limited, England

[21] Appl. No.: 246,263

[22] Filed: Sep. 19, 1988

[30] Foreign Application Priority Data

Oct. 1, 1987 [GB] United Kingdom ..... 8723030

[51] Int. Cl.[5] ..... B01F 3/04

[52] U.S. Cl. ..... 261/43; 261/DIG. 7; 137/68.1; 137/797; 220/89 A; 222/541

[58] Field of Search ..... 261/DIG. 7, 43; 137/68.1, 797; 220/89 A; 222/541

[56] References Cited

U.S. PATENT DOCUMENTS

| | | | |
|---|---|---|---|
| 2,580,426 | 1/1952 | Heigis | 220/89 A |
| 3,169,658 | 2/1965 | Porter | 220/89 A |
| 3,216,611 | 11/1965 | Lechevallier | 137/68.1 |
| 3,385,481 | 5/1968 | Frangos | 137/797 |
| 4,102,469 | 7/1978 | Shegrud et al. | 220/89 A |
| 4,207,913 | 6/1980 | Fike, Jr. | 137/68.1 |
| 4,479,587 | 10/1984 | Mundt et al. | 137/68.1 |
| 4,512,491 | 4/1985 | DeGood et al. | 220/89 A |
| 4,590,957 | 5/1986 | McFarlane | 137/68.1 |
| 4,657,157 | 4/1987 | Short, III | 137/68.1 |
| 4,660,740 | 4/1987 | Brandon, Jr. et al. | 222/1 |

FOREIGN PATENT DOCUMENTS

| | | | |
|---|---|---|---|
| 2143939 | 3/1973 | Fed. Rep. of Germany . | |
| 1141818 | 9/1957 | France . | |
| 793590 | 4/1958 | United Kingdom . | |
| 1338747 | 11/1973 | United Kingdom . | |
| 2161089 | 1/1986 | United Kingdom | 261/DIG. 7 |

*Primary Examiner*—Tim Miles

*Attorney, Agent, or Firm*—Lerner, David, Littenberg, Krumholz & Mentlik

[57] ABSTRACT

A pressure vessel has an excess pressure release device comprising a passage between the interior and the exterior of the pressure vessel, a bursting disc seated in the passage, and a flexible membrane mounted adjacent to the disc between the interior of the vessel and the disc so as to seal the passage and hold the disc captive without the disc being clamped. The excess pressure release device may be used in connection with any pressure vessel requiring an excess pressure release device of the bursting-disc type. The device is particularly suitable for use in the dispensing valve of a home carbonation apparatus.

7 Claims, 2 Drawing Sheets

PRESSURE VESSEL

This invention relates to a pressure vessel, comprising an excess pressure release device.

In a known arrangement for excess pressure release, illustrated in FIG. 1, the wall 1 of a pressure vessel, which may be, for example, the carbonation chamber of a home carbonation apparatus, is provided with an outlet in the form of a screw threaded boss 2, the screw threaded portion 3*a* of the bore 3 therethrough extending from the exterior of the vessel to a shoulder 4. A clamping plug 5 having a bore 6 therethrough is threaded into the screw threaded portion 3*a* so as to engage the periphery of the bursting disc 7 to clamp the disc against the shoulder 4 to form a fluid tight seal. The bursting disc 7 is a frangible member which will burst when the pressure on one face thereof exceeds a predetermined value. For low pressure use, for example up to about 100 psig, the disc may be formed of graphite, bursting at 1.5 to 3.5 times the working pressure. Metal and plastics discs are also known for use at such pressures. A problem with this known arrangement is that the fluid tight seal is dependent upon the clamping action of the clamp plug 6 on the bursting disc 7. If the plug 6 is not tightened sufficiently leakage of the fluid may occur from within the pressure vessel around the disc, whereas if excessive pressure is applied, the strength of the disc may be significantly reduced, thereby leading to bursting at a lower pressure, possibly within the working pressure of the pressure vessel.

One aspect of the present invention provides a pressure vessel comprising an excess pressure release device in which a separate sealing member is used with the pressure release member. The sealing member may be arranged to transmit the pressure of the interior of the vessel to one side of the pressure release member.

In one preferred embodiment of the invention, the passage comprises first and second portions of different width with a shoulder therebetween, the first portion being of lesser width and being nearer to the interior of the pressure vessel, and the second portion being screw threaded to receive a threaded plug therein, the plug having a longitudinal bore therethrough, the bore of the plug having a portion of greater width at the end thereof nearer to the interior of the pressure vessel, the bore of greater width receiving therein the pressure release member, the sealing member preferably comprising a sealing disc of a resilient material, clamped between the plug and the shoulder in the outlet.

In another embodiment of the invention the pressure release member, for example a bursting disc, is retained in a seating therefor by the membrane.

Another aspect of the invention provides a pressure vessel comprising an outlet valve and an excess pressure release device incorporated in said outlet valve. This arrangement has the advantage that separate provision in the pressure vessel of a pressure release device is not required, simplifying construction of the pressure vessel. The arrangement is applicable to a home carbonation apparatus of the type described and claimed in our published U.K. Patent Application No. 2161089 wherein the pressure vessel is a carbonation chamber which has an outlet valve which includes a hollow cylindrical sleeve mounted for vertical sliding movement in a aperture in the base of the chamber. The sleeve has lateral openings near its upper end and a head which carries a seal which engages the inside surface of the bottom wall of the chamber when the sleeve is in its lower position so that water cannot escape from the chamber.

Preferably, in accordance with another preferred embodiment of the present invention, the head of the sleeve has a recess therein facing the interior of the vessel, in which recess a pressure release member is received, and the sealing member comprises a resilient cap for the valve head.

In the pressure vessel of the present invention, the pressure release member does not itself serve a fluid sealing function, and may therefore be a loose fit in its seating, since no clamping is required. The sealing member, which may be a membrane of a rubber material provides a fluid tight seal while not significantly affecting the bursting pressure of the pressure release member, e.g. a bursting disc. Further, when graphite bursting discs are used, there is a possibility that leakage of fluid may occur through the graphite. The rubber membrane also avoids this problem.

Reference is made to the drawings, in which.

Figure 1:
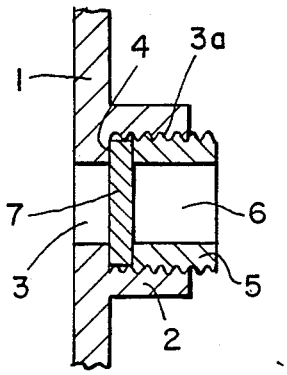
FIG. 1 shows a known pressure release arrangement for a pressure vessel, as hereinbefore described.
Figure 2:
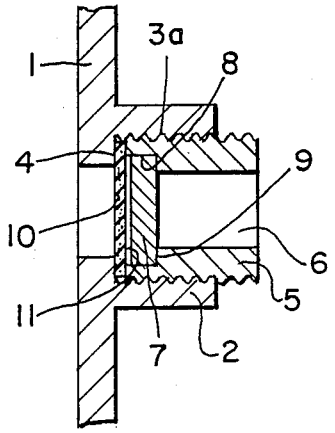
FIG. 2 is a sectional view of an excess pressure release device in a pressure vessel according to a first embodiment of the present invention.

Referring to FIG. 2, the parts of the excess pressure release device which correspond to those shown in FIG. 1 are identified by the same numbers. In FIG. 2, however, the bore 6 through the clamping plug 5 has a portion 8 at the inner end thereof having a diameter greater than the remainder of the bore, with a shoulder 9 between the two portions. The bursting disc 7 is received in the portion 8 and rests against the shoulder 9. A disc shaped elastomeric sealing membrane 10, for example of rubber, is clamped by the clamping plug 5 against the shoulder 4 to provide a fluid tight seal. The bursting disc thus has no sealing function, and it is therefore unnecessary for the bursting disc to be a precise fit in the portion 8 of the bore. The disc 7 and the portion 8 of the bore are dimensioned so that a small clearance 11 exists between the face of the bursting disc 7 and the end of the plug when the disc 7 is seated against the shoulder 9. This ensures that no clamping pressure is exerted upon the bursting disc, which pressure would possibly lead to a reduction in its strength. In use, the fluid pressure within the pressure vessel will cause the rubber sealing membrane to be pressed against the bursting disc. The membrane 10 may be made relatively thin, for example, so that substantially the full fluid pressure is exerted on the bursting disc, and the bursting pressure is not substantially changed.

Figure 3:
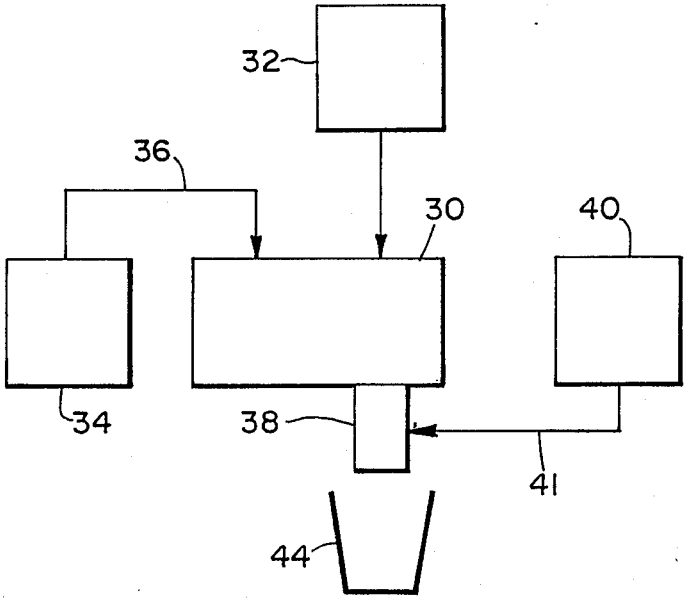
FIG. 3 is a diagram illustrating a home carbonation apparatus having a carbonation chamber which is a pressure vessel in accordance with a second embodiment of the invention.

Referring now to FIG. 3, a home carbonation apparatus comprises a carbonation chamber 30 to which water can be supplied from a reservoir 32. Carbon dioxide is admitted to the chamber from a cylinder 34 via feed line 36 and is dissolved into the water for example bY being injected into the water at a low IeveI, or by the action of mixing paddles, for example, in the manner described in our published U.K. Patent Application No. 2161089.

The apparatus includes a dispensing valve arrangement 38 which can be selectively supplied with flavoured syrups from reservoirs 40 via feed lines 41, one only being shown in the diagram. The carbonated drink is dispensed into a drinking glass 44, for example.

Figure 4:
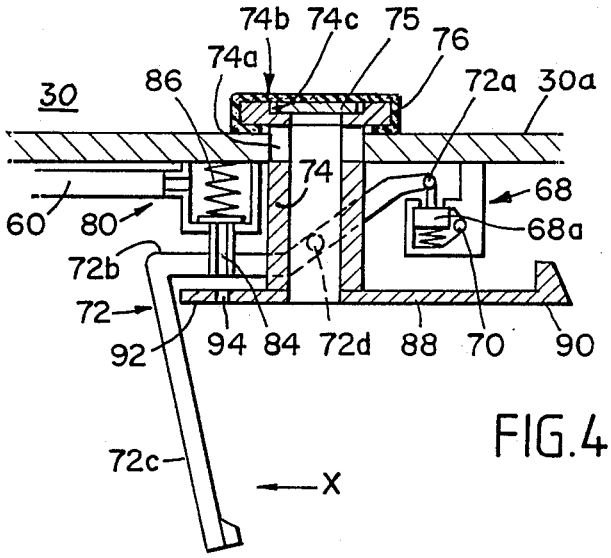
FIGS. 4 and 5 are enlarged sectional views of a combined liquid discharge valve and excess pressure release device in a home carbonation apparatus of the type illustrated by FIG. 3.
Figure 5:
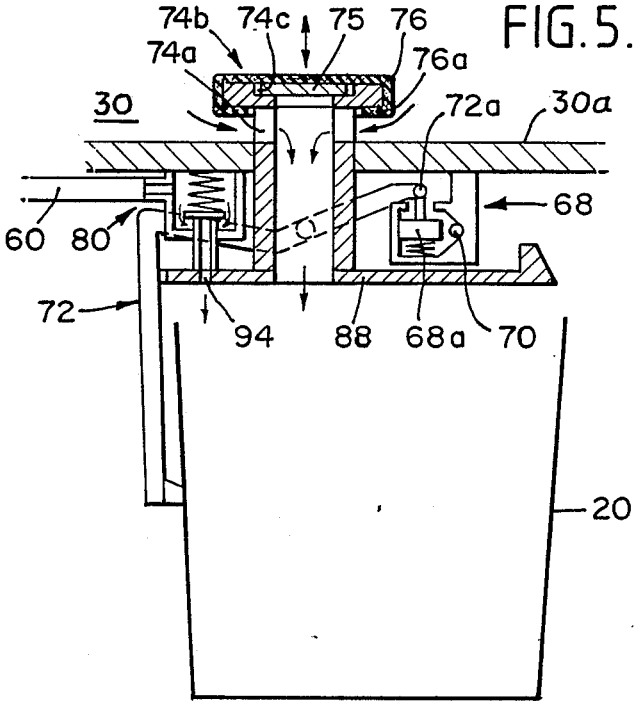

FIGS. 4 and 5 illustrate the construction and operation of a suitable dispensing valve arrangement 38 for a home carbonation apparatus of the type described generally with reference to FIG. 3. The valve arrangement 38, details of which are illustrated in FIGS. 4 and 5, provides three functions. Firstly, it relieves the pressure in the carbonation chamber 30. Secondly, it permits selection of any one of a plurality of flavouring syrups from the reservoirs 40 and dispenses the selected syrup. Thirdly, it dispenses carbonated water from the chamber 30. The first of these functions has, however, been found not to be essential, and can be omitted.

For relieving the pressure in the carbonation chamber 30, the dispensing valve arrangement 38 comprises an exhaust valve 68 which is connected to the upper part of the chamber 30 by a conduit 70. The exhaust valve 68 includes a vertically movable valve member **68*a* which is spring biased to its upper, closed, position. An actuating lever 72 is pivotally connected at one end 72*a* thereof to the valve member 68*a* for pushing the valve member 68*a* downwards to open the valve 68, thereby permitting gas in the upper part of the chamber 30 to be exhausted to atmosphere through the conduit 70 and the valve 68**.

The actuating lever 72 comprises an upper arm **72*b* and a downwardly directed arm 72*c*. The lever 72 is attached by a pivot 72*d*, intermediate the ends of the upper arm 72*b*, to a hollow cylindrical sleeve 74 which is mounted for vertical sliding movement in an aperture in the base 30*a* of the chamber 30. The sleeve 74 forms a valve for permitting discharge of carbonated water from the chamber 30, and for this purpose has lateral openings 74*a* near the upper end thereof, and a head 74*b* which seats against the inside surface of the bottom wall 30*a* of the chamber 30 when the sleeve 74 is in its lower position, so that water cannot escape from the chamber 30. A recess 74*c* is provided in the upper face of the head 74*b* to provide a seat for a bursting disc 75. The recess 74*c* opens through to the interior of the sleeve 74. A cap 76 of thin elastomeric material such as rubber is provided over the head 74*b*, the lower portions 76*a* thereof serving as a seal on the under side of the head which engages the inner surface of the bottom wall 30*a* of the chamber 30, while the upper part provides a seal for the bursting disc 75. Excess pressure within the chamber when the valve is closed is transmitted through the rubber seal to the bursting disc 75, causing the disc to burst if the pressure in the chamber exceeds a predetermined level, for example 1.5 to 3.5 times the normal working pressure which may, for example, be at a level within the range 100 to 150 psi. The rubber seal is arranged to burst at the same time. Thus, the contents of the chamber will be ejected through the sleeve 74** relieving the excess pressure.

At completion of carbonation, the chamber 30 remains pressurised so that valve head **74*b* is pressed firmly against the inside surface of the bottom wall 30*a* of the chamber 30, with the portion of the sealing cap 76*a* therebetween. Consequently, if the downwardly directed arm 72*c* of the lever 72 is moved to the left as shown by the arrow X in FIG. 4, the lever 72 rotates about the pivot 72*d*, the sleeve 74 remaining stationary so that the valve 68 is opened thus relieving the pressure in the chamber 30. Continued movement of the arm 72*c* in the direction of arrow X in FIG. 4 will cause the lever to pivot about its end 72*a*, so the sleeve 74 slides upwardly to the position shown in FIG. 5, in which position the sleeve valve 74 is opened to permit carbonated water to be discharged from the chamber 30. The actuating member 72 is designed so that its lower arm 72*c* is arranged to be engaged by the glass 20 when placed in position, so that as the glass 20 is moved to the left relative to the valve unit as seen in FIGS. 4 and 5, firstly the valve 68 is opened, the sleeve 74 being held stationary by the pressure in the chamber 30, and thereafter, when the pressure in the chamber 30 has been relieved, the sleeve 74 moves upwardly to discharge carbonated water through the opening 74*a* and the sleeve 74 into glass 20**.

The valve unit 38 includes three syrup dispensing valves, each connected to a respective reservoir. One of the dispensing valves 80, is shown in the drawings. The valves are of essentially identical construction. The valve 80 comprises a vertically movable valve member 84 urged downwardly by a spring 86 to the closed position thereof (FIG. 4). A selector bar 88 is secured to the lower end of the sleeve 74, which is rotatable about its axis (which is vertical). One end of the bar 88 carries a finger grip 90 for effecting this rotation so as to position the opposite end 92 beneath a selected one of the valves (80). When the sleeve 74 is raised by actuation of the lever 72 so as to discharge carbonated water into the glass 20, the selected valve 80 is engaged by the end 92 of the bar 88 so as to open the valve by raising valve member 84. The construction of the valve member 84 is similar to that of the sleeve 74, i.e. it is hollow and is provided with lateral apertures so that the syrup is discharged through the selected valve member 84, through an aperture 94 in the bar 88, and thereby into the glass 20.

Although the invention is particularly described hereinbefore with reference to home carbonation apparatus, and is particularly suitable for use in such apparatus, the pressure vessel may be any pressure vessel requiring an excess pressure release device of the bursting disc type, for example a gas cylinder. The preferred embodiments of the invention are particularly advantageous in that they are simple, inexpensive and reliable. The elastomeric sealing member, such as member 10 or 76, does not need to withstand even the normal working pressures in the pressure vessel because, in normal operation, it is supported by the bursting disc. Bursting discs are normally made of brittle material, such as graphite, which, whilst being capable of withstanding pressures at and above the normal working pressure of the pressure vessel when undamaged there is a risk that where these discs are clamped to form a seal damage resulting in weakening or breakage may arise, this being substantially avoided in the invention.

I claim:

1. A presure vessel having an excess pressure release device which comprises an outlet from the pressure vessel, a sealing member closing said outlet, and a pressure release member to which force derived from the pressure in the vessel is transmitted via said sealing member and which is arranged to break when said pressure exceeds a predetermined level so that said pressure may be released through said outlet, wherein said sealing member comprises a flexible membrane arranged across said outlet and secured at its perimeter, and said pressure release member is a disc formed of brittle material and is captive in a space defined by said flexible membrane and an abutment and displaceable in said space.

2. A vessel according to claim 1, including plug means mounted in said outlet, said plug means clamping said sealing member in position, and said plug means defining said abutment which is spaced from the sealing member to permit said displacement of said disc.

3. A pressure vessel according to claim 2, wherein said plug means comprises a threaded member threaded into said outlet.

4. A vessel according to claim 1, wherein said flexible membrane is formed from an elastomeric material.

5. A pressure vessel having an excess pressure release device which comprises an outlet from the pressure vessel, a sealing member closing said outlet, and a pressure release member to which force derived from the pressure in the vessel is transmitted via said sealing member and which is arranged to break when said pressure exceeds a predetermined level so that said pressure may be released through said outlet, wherein said vessel includes an outlet valve for discharging liquid from said vessel, said outlet, said sealing member and said pressure release member being provided in said outlet valve, and wherein the outlet valve comprises a hollow sleeve slidable in an aperture in a wall of the pressure vessel, the sleeve having a head arranged to seat on the inner face of the wall and at least one aperture to permit fluid flow from the vessel into the hollow sleeve when the head is spaced from the wall, the head having said outlet therethrough, and the sealing member comprising a resilient cap for the head.

6. A pressure vessel according to claim 5, wherein the resilient cap provides a resilient seal between the head of the sleeve and the inner face of the wall.

7. A pressure vessel according to either claim 5 or claim 6, wherein the pressure release member is a graphite bursting disc.

* * * * *